United States Patent [19]

Schuster et al.

[11] Patent Number: 4,584,831

[45] Date of Patent: Apr. 29, 1986

[54] DEVICE FOR THE FALSE TWISTING OF THREADS BY MEANS OF FRICTION DISKS

[75] Inventors: Friedrich Schuster; Günther Paul, both of Hammelburg, Fed. Rep. of Germany

[73] Assignee: FAG Kugelfischer Georg Schafer KGaA, Fed. Rep. of Germany

[21] Appl. No.: 729,551

[22] Filed: May 2, 1985

[30] Foreign Application Priority Data

May 25, 1984 [DE] Fed. Rep. of Germany ..... 3419484

[51] Int. Cl.[4] ..... D01H 7/92; D02G 1/08

[52] U.S. Cl. ..... 57/339; 57/348

[58] Field of Search ..... 57/104, 337, 338, 339, 57/340, 348, 88, 89

[56] References Cited

U.S. PATENT DOCUMENTS 3,942,313 3/1976 Gassner et al. ..... 57/339

4,112,664 9/1978 Muhlegg ..... 57/339

*Primary Examiner*—Donald Watkins

*Attorney, Agent, or Firm*—Ostrolenk, Faber, Gerb & Soffen

[57] ABSTRACT

Two complete friction false-twisting units are disposed within a very narrow space on only a single base plate. Only one pivot mount is provided for the base plate, whereby the drive whorls of each of the two units can be pivoted toward and away from the drive belt. The capacity of a thread texturing machine can be doubled thereby.

12 Claims, 3 Drawing Figures

DEVICE FOR THE FALSE TWISTING OF THREADS BY MEANS OF FRICTION DISKS

BACKGROUND OF THE INVENTION

The invention relates to a device for the false-twisting of threads by means of friction disks, and more particularly to a support for a plurality of false-twisting units.

A friction false-twist unit comprises a plurality of adjacent, parallel, rotatable shafts carrying friction disks, and disks on neighboring shafts of the unit are interleaved for enabling rubbing of a thread pulled past the disks. For economy in space, it is desirable to place a plurality of such false-twisting units near each other.

Federal Republic of Germany Pat. No. 24 01 776 describes a tandem arrangement having two coupled thread guides which can be employed on a double friction false-twist unit. This arrangement has the disadvantage that it projects a very large distance and thereby requires a large amount of setting-up surface. Furthermore, the thread guide mechanism is very expensive and the threading is time-consuming.

In Federal Republic of Germany Provisional Pat. No. DE-AS 21 30 550, the possibility of a plurality of thread places is created by the interengagement of a plurality of disks. The increased wear of the disks is obvious. In addition, there is a rather expensive adjustment of the disks, so that such a unit has not been able to gain acceptance on the market.

Federal Republic of Germany Application No. DE-OS 15 10 770 describes a motor-driven two-disk double unit. The disadvantage of a two-disk unit resides in the inaccurate fixing of the thread. Due to the motor drive and the arrangement of the two pairs of disks, this unit also projects greatly and is uneconomical.

SUMMARY OF THE INVENTION

The object of the present invention is to eliminate these drawbacks and to provide a neatly arranged, compact and readily operated arrangement which takes up only a small amount of space.

The arrangement of the invention makes it possible to arrange two complete units in a very narrow space on only one base plate. The two units are disposed on opposite sides of the endless drive belt for the units. Each unit comprises three parallel shafts. Each shaft carries respective friction disks in a stack, and the shafts are so placed and the disks are so sized that the disks of each unit are interleaved. The two units are so oriented that the respective sides of their equilateral triangles are parallel. As a result, the first, upstream unit has a base line between two of its shafts that generally parallels the path of the drive belt for the false twisting device. The corresponding base line of the second, downstream unit, on the other hand, is spaced away from the drive belt. The drive whorl of the first upstream unit is upstream while the other drive whorl of the second, downstream unit is downstream in the path past the drive whorls of the belt. The drive whorl of the upstream unit is on the upstream shaft of the base line of that unit. The drive whorl of the downstream unit is on the shaft which is not on the base line of the downstream unit.

The drive whorls of the two units are developed relatively large. The units are arranged so that the base line of the upstream unit is inclined so that its upstream end is spaced further from the drive belt than its downstream end, and the angle between both parallel base lines of both units and the drive belt amounts to at most 20°. It is thereby possible to arrange the units one upstream of the other. Both units are accessible from the front for operation. The threading is effected preferably with a mobile threader which, after removal of the threader from the unit, permits the course of the thread to be visible again.

The base plate has one pivot mount, and rotation of the base plate moves the drive whorls of both units into and out of engagement with the drive belt together. This enables the simultaneous engagement and disengagement of both drive whorls with the belt. Due to the common pivot point of the base for both units, only one mounting device is necessary. It is fastened to a spindle-bearing plate, which is of great economic advantage as compared with individual units.

Numerous texturing machines which are equipped with individual units are available on the market. Many processors are interested in using so-called plied yarns, i.e. S-Z yarns, on these machines. Conversion is not possible here with traditional units since the divisions are too narrow and the units protrude too far. The invention now permits use of plied yarn and also enables doubling of the production of the traditional machines without changing the machine. The financial advantage is apparent.

Other objects and features of the invention are explained below with reference to the accompanying drawings.

DESCRIPTION OF THE PREFERRED EMBODIMENT

Figure 1:
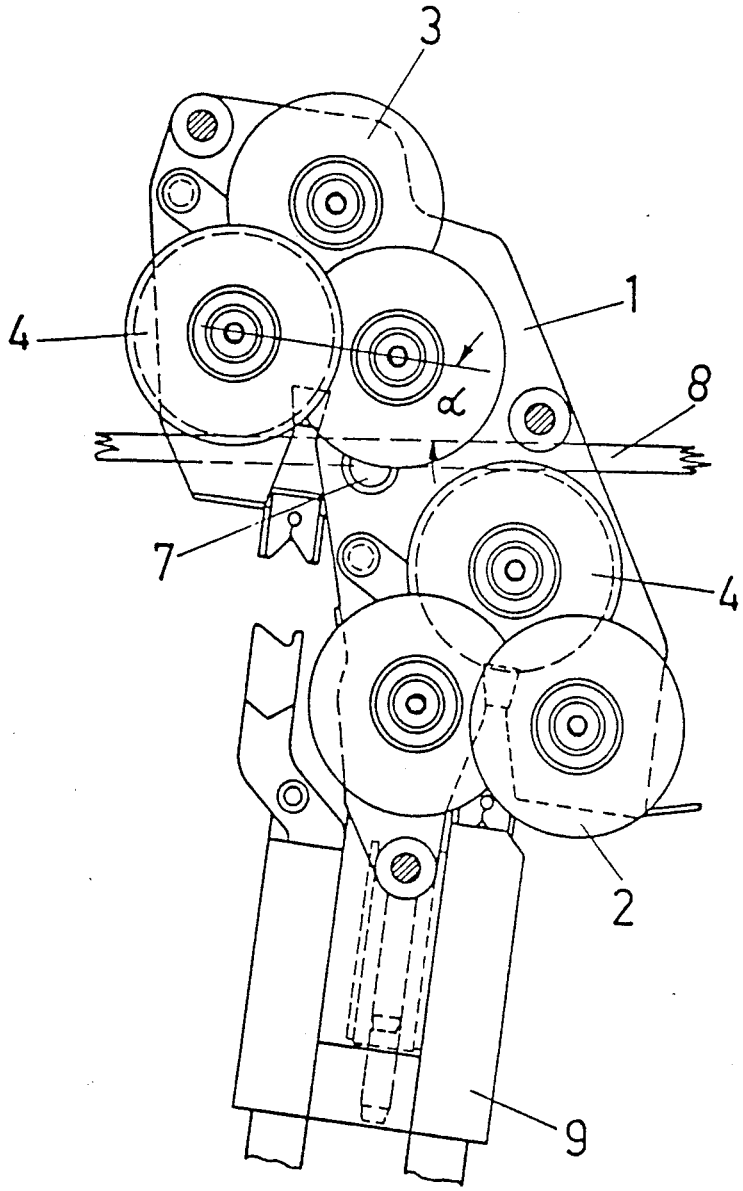
FIG. 1 is a plan view of the double unit arrangement in accordance with the invention, and the mobile threader is also shown.
Figure 2:
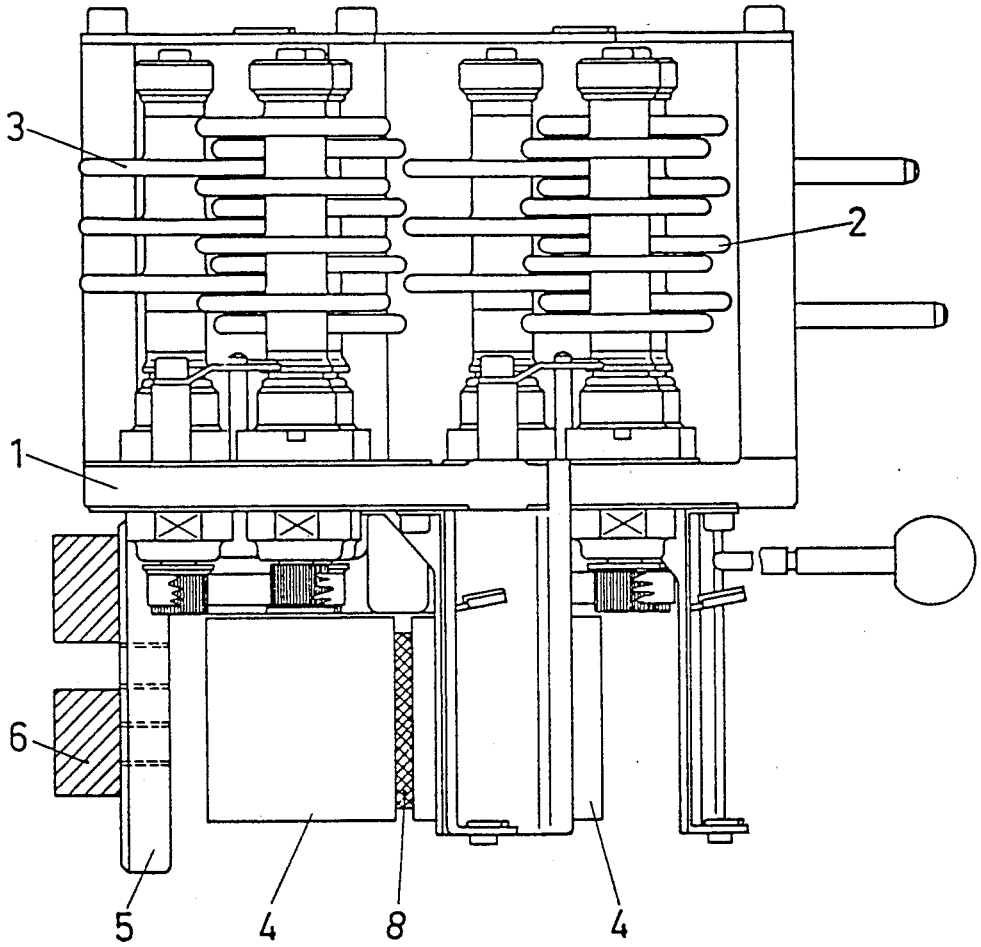
FIG. 2 is a side view of the double unit, also showing the mounting device and the spindle-bearing plate.

The double unit of the invention includes a base plate 1 that supports the two units 2 and 3. The unit 2 is at the front of the machine and in front of the drive belt and the unit 3 is at the rear. Each unit 2 and 3 is a known three-shaft false-twist unit, including three interconnected, parallel shafts, such that rotation of one shaft drives the other shafts to rotate correspondingly. The manner of interconnection, e.g. by an adjustable belt, is known for controlling the directions of shaft rotation. Each shaft carries a stacked plurality of spaced apart friction disks whose edges rub the thread being pulled along the length direction of the shafts. The disks on all three shafts of one unit are interleaved alternately, as shown.

Both units 2 and 3 have respective drive whorls 4 which is on one shaft of the unit and is located axially beneath the friction disks. The drive whorls 4 of the front unit 2 and of the rear unit 3 rest against opposite sides of the same endless driving belt 8. The whorl of one unit is upstream of the below described pivot point 7 of the base plate, and the whorl of the other unit is downstream of that pivot.

Each of the units 2 and 3 has its respective shafts arranged to define the corners of an equilateral triangle. The shafts are so oriented on the base plate 1 that the respective sides of the two equilateral triangles are parallel. The base line of the more upstream unit 3 is between the two shafts that generally extend parallel to the path of the drive belt therepast. The parallel base line of the more downstream unit 2, in contrast, is spaced further away from the drive belt. The drive whorl 4 for the upstream unit 3 is on the base line. The drive whorl for the downstream unit 2 is on the shaft that is not on the base line. The base lines are generally inclined with respect to the path of the drive belt therepast, and the upstream end of the upstream base line is further from the drive belt than the downstream end of that baseline. The angle of the inclination is at most 20°. That angle of inclination is indicated by the alpha symbol.

The two units 2 and 3 are arranged on the base plate 1, and the base plate is, in turn, anchored on the mounting device 5 at a single pivot point 7 which is centered between the units, equidistant from the drive whorls. The device 5, in turn, is carried on the fixed spindle-bearing plate 6. The drive whorls 4 rest against the drive belt 8. The drive whorls are at least 30 mm in diameter and preferably are 44 mm in diameter. The drive belt is an endless belt, and only the fragment of the belt moving past the units is shown. The complete unit 2, 3, including the unitary base plate 1, can be engaged and disengaged by rotating the plate 1 in one plane around the centrally disposed pivot point 7. This moves the whorls 4 simultaneously into and out of engagement with the belt 8.

Figure 3:
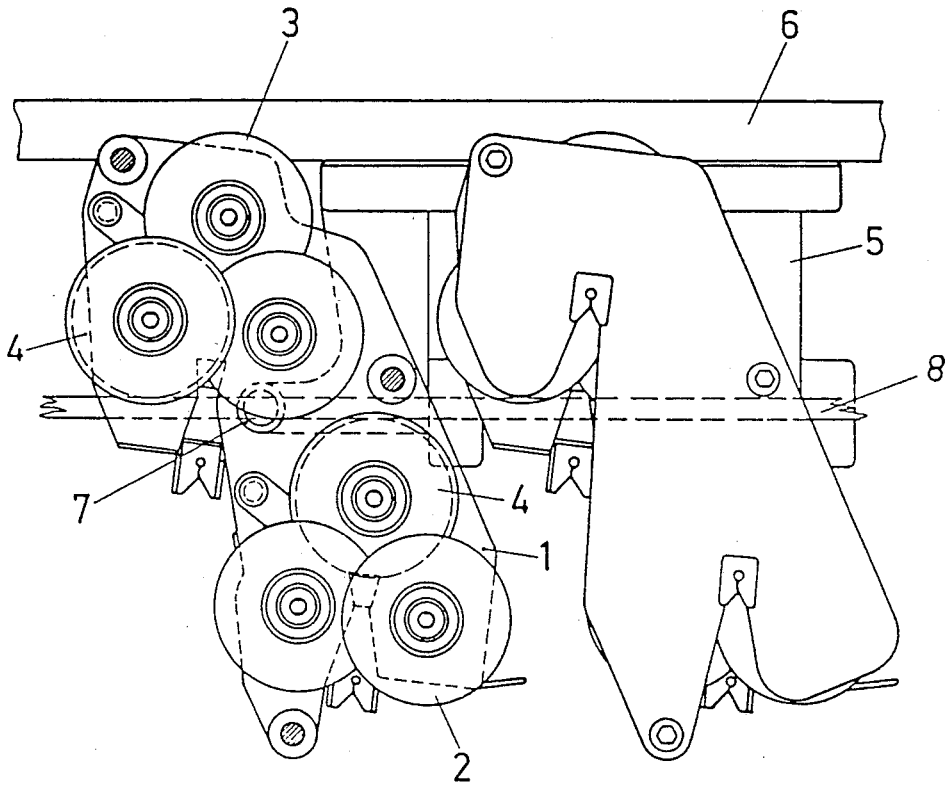
FIG. 3 shows the arrangement of two units lying alongside of each other.

Obviously, while only a single pair of units on a single base plate is illustrated, a large series of these double unit arrangements may be provided. FIG. 3 shows a top view of two double units as they are installed in actual practice.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A device for false twisting threads, comprising:

a first and a second false twisting unit; each of the units comprises a plurality of three parallel shafts which are arranged to define the corners of an equilateral triangle; the shafts of both of the units extending parallel; each shaft carrying respective friction disks in a spaced apart stack on the shaft; the shafts being so spaced and the disks being so sized that the disks on the shafts of each unit are interleaved;

a base for the first and the second units;

each of the units having a respective drive whorl for driving one of the shafts of the respective unit to rotate; the other shafts of the respective unit being connected with the one shaft thereof for the shafts to be rotated together by driving of the respective drive whorl;

a drive belt movable in a drive direction past and between the first and the second units on the base, and the belt being for contacting the drive whorls of both units and for rotating the drive whorls; and the first unit being slightly upstream of the second unit with respect to the motion of the drive belt; the drive whorl of the first unit being further upstream of the drive belt and the drive whorl of the second unit being further downstream of the drive belt; the disks of each unit being spaced from the disks of the other unit.

2. The false twisting device of claim 1, wherein the base supports the two units for joint motion; a single pivot for the base, and the pivot being placed such that the base can be pivoted to pivot the drive whorls of both units simultaneously toward and away from the drive belt.

3. The false twising device of claim 2, wherein the respective drive whorl of each of the units is on one of the shafts of the unit.

4. The false twising device of claim 3, further comprising a bearing plate for supporting the base, and the bearing plate being located toward one side of the base; the first unit being closer to the bearing plate and the second unit being spaced further away from the bearing plate.

5. The false twising device of claim 4, further comprising a mount for fastening the units to the bearing plate.

6. The false twising device of claim 4, wherein each of the units is individually removable from the false twisting device.

7. The false twising device of claim 3, wherein the two triangular arrays of shafts respectively of the two units are each oriented such that the respective sides of both triangles are parallel as the arrays are supported on the base.

8. The false twising device of claim 7, wherein two of the shafts of each of the units defines a base line and the base line is generally oriented along the path of the drive belt past the respective unit; the drive whorl of the first unit being on the upstream one of the shafts on the base line of the first unit; the base line of the second unit is parallel to the base line of the first unit, and the base line of the second unit is further from the drive belt than the base line of the first unit; the drive whorl of the second unit being on the shaft of the second unit that is not on the base line of the second unit.

9. The false twising device of claim 8, wherein the base lines of both of the units are inclined to the direction of the drive belt therepast and are inclined in a direction such that the upstream end of the base line of the upstream first unit is further from the belt than the downstream end of the base line of the first unit.

10. The false twising device of claim 9, wherein the base lines are inclined at an angle to the path of the drive belt therepast of at most 20°.

11. The false twising device of claim 3, wherein each drive whorl has a diameter of at least 30 mm.

12. The false twising device of claim 11, wherein each drive whorl has a diameter of 44 mm.

* * * * *